US008464477B2

(12) United States Patent
Bowlus et al.

(10) Patent No.: US 8,464,477 B2
(45) Date of Patent: Jun. 18, 2013

(54) SEISMIC BASE ISLOATION AND ENERGY DISSIPATION DEVICE

(75) Inventors: Larry Richard Bowlus, Anchorage, AK (US); Heidi Marie Bowlus, Anchorage, AK (US); Robert Hawley Bowlus, Chugiak, AK (US); Rebecka Joymae Bowlus, Anchorage, AK (US); Ambrosia Danielle Bowlus, Anchorage, AK (US); Katherine Leigh Bowlus, Anchorage, AK (US); Marvin Jones, Anchorage, AK (US)

(73) Assignee: Larry Bowlus, Anchorage, AK (US)

( * ) Notice: Subject to any disclaimer, the term of this patent is extended or adjusted under 35 U.S.C. 154(b) by 0 days.

(21) Appl. No.: 13/199,032

(22) Filed: Aug. 18, 2011

(65) Prior Publication Data

US 2013/0042546 A1 Feb. 21, 2013

(51) Int. Cl.
*E04B 1/98* (2006.01)
*E04H 9/02* (2006.01)

(52) U.S. Cl.
USPC ..... 52/167.4

(58) Field of Classification Search
USPC . 52/167.1, 167.4, 167.6, 167.7, 167.8; 384/7, 384/17, 20, 26, 34, 37, 54, 98
See application file for complete search history.

(56) References Cited

U.S. PATENT DOCUMENTS

| | | | | |
|---|---|---|---|---|
| 4,587,773 | A * | 5/1986 | Valencia | 52/1 |
| 4,823,522 | A * | 4/1989 | White | 52/167.7 |
| 5,533,307 | A * | 7/1996 | Tsai et al. | 52/167.3 |
| 5,971,347 | A * | 10/1999 | Tsai et al. | 248/618 |
| 6,237,292 | B1 * | 5/2001 | Hegemier et al. | 52/273 |
| 6,862,848 | B1 * | 3/2005 | Lang et al. | 52/167.1 |
| 2007/0006538 | A1 * | 1/2007 | Chuang | 52/167.4 |

* cited by examiner

*Primary Examiner* — William Gilbert
*Assistant Examiner* — Kyle Walraed-Sullivan

(57) ABSTRACT

Seismic base isolation and energy dissipation device using a plurality of swing plate's that are placed on a central wall. This arrangement creates a strong load bearing swing beam that moves in true pendulum fashion. This system is placed between the structural load and its foundation. This seismic wave base isolation system has the purpose of absorbing seismic wave displacement energy in all directions. This unique design can scale up for very large and heavy loads or scale down to protect sensitive cargo and equipment from destructive motion. The swing plates inside the swing beam will provide support and absorption of motion by moving as a pendulum and therefore redirecting and dissipating seismic energy. This system has a simple design shape and is therefore inexpensive to construct, is easy to engineer and deploy, it requires no uncommon material and requires very little maintenance or advanced electronics.

3 Claims, 10 Drawing Sheets

SEISMIC BASE ISLOATION AND ENERGY DISSIPATION DEVICE

CROSS-REFERENCE TO RELATED APPLICATIONS

CURRENT INTERNATIONAL CLASS: F16F 15/00; E048B 1/98

CURRENT U.S. CLASS: 52/167.6, 248/20, 52/167, 248/358 R, 33/391-392,

FIELD OF SEARCH: 52/167.6, 248/358 R, 19, 20, 21; 52/167, 98, 99, 188/13, 248/562, 248/636,

REFERENCES CITED

| | | | | |
|---|---|---|---|---|
| 6,126,136 | A | October | 2000 | Yen et al |
| 6,164,022 | A | December | 2000 | Ishikawa et al |
| 6,385,917 | B1 | May | 2002 | Konomoto |
| 6,725,612 | B2 | April | 2004 | Kim |
| 6,820,380 | B2 | November | 2004 | Tasi |
| 6,862,849 | B2 | February | 2005 | Kim |
| 6,948,284 | B2 | September | 2005 | Chiang |
| 6,966,154 | B1 | November | 2005 | Bierwirth |
| 7,409,799 | B2 | August | 2008 | Tsai |
| 7,472,518 | B2 | January | 2009 | Chong-Shien Tsai |

This invention is not the result of any federally sponsored research.

BACKGROUND OF THE INVENTION

1. Technical Field

This invention relates to Seismic base isolation and energy dissipation devices for structures. The present invention will be placed between a structural load and its foundation.

2. Background Art

Many devices and equipment systems exist to reduce the seismic ground motion energy that is transmitted to a structure when an earthquake event occurs. Many of these earthquake motion protective systems fall in the category of base or foundation isolation systems, as does the present invention. Some of the most complex units are those that reply on pendulum like motion where gravity supplies the force to dampen the energy and restore the supported load to its original point of equilibrium and stability. A common draw back of most prior art of these base isolation systems are they are very expensive and complex. Also these systems require uncommon and difficult to manufacture materials and some require advanced technologies in the fields of electronics, computers and hydraulics. Yet another drawback is many only allow movement in two perpendicular directions. Many of these pendulum systems require constant monitoring and are costly to maintain or need replacement after a seismic event. The engineers designing the older pendulum systems often focus all the seismic energy on to a few pivotal moving parts creating a lot of stress on these complex parts, making it very hard to predict their reliability or extend their application to support larger structures, also limiting the amount of ground movement they could handle. The present invention overcomes many of these drawbacks by introducing a new design that will not focus the seismic motion to a few unique and often over loaded parts. The present invention will scale easily to support large size structural load while remaining the same design or shape, except for using thicker materials and greater dimensions to accommodate larger loads. The present invention will reduce or prevent structural damage and it will eliminate all the previously cited short comings of high cost and mechanical complexity, and limited range of applications also the present invention will be easy to assembly, easy to install and will require very little maintenance.

3. Description Prior Art

A protective system for seismic base isolation and energy dissipation is well known and has many design configurations; most of the prior art of invention for earthquake base isolation systems are very expensive and of complex design. They often require-special materials also they are hard to manufacture. Most do not scale up easily and they usually require constant maintenance. Many are difficult to re-engineer or provide options for other applications. Most need to be refurbished or replaced after a quake event and they have limited ground displacement range. Many are very limited in there ability to dissipate seismic energy and most do not have energy damping options. Many do not accommodate all three axis of movement and lastly most focuses all the quake displacement energy in to a few pivotal parts.

For example U.S. Pat. No. 6,725,612 B2 issued Apr. 27, 2004 to Kim. This system uses a multi layer assembly of bi-directional rollers placed on a upper and a lower curved guide rail that is set at right angles to each other and are designed to roll in a pendulum like motion. This system is expensive, complex and has many unique specialized parts, also this system not easy to create and will not scale up to handle very large structures, it also will require maintenance, to continue this system is more difficult to engineer. This system will need to be refurbished after quake events also this system can not handle large ground displacement or dissipate very much seismic energy. This system has no stated solution for a vertical displacement event and very limited energy damping. This pendulum like system seems to focus all the immense energy coming from a seismic event in to a few pivotal moving parts creating huge stresses making it very difficult to have long term reliability.

Another example is U.S. Pat. No. 6,966,154 B1 issued Nov. 22, 2005 to Bierwirth. This system uses an arrangement of Virtual Pendulums called Quakeprotect modules. The goal is to suspend the entire building structure from long rods allowing the structure to sway gently in an earthquake. The claim is that this system can provide protection even in the maximum possible magnitude of earthquake. This system is expensive, complex and has many unique specialized parts, also this system not easy to create and will not scale up to handle very large structures, it also will require maintenance, to continue this system is more difficult to engineer. This system will need to be refurbished after quake events also this system does claim to handle large ground displacement and dissipate seismic energy. This system has no stated solution for a vertical displacement event and very limited energy damping. This pendulum like system seems to focus all the immense energy coming from a seismic event in to a few pivotal moving parts creating huge stresses making it very difficult to have long term reliability.

Another example is U.S. Pat. No. 6,948,284 B2 issued Sep. 27, 2005 to Chiang. This system claims an all directional damping and earthquake resisting unit comprising multiple balls that will roll inside this assembly having at least one inner-upper carrier and at least one inner-lower carrier with a surface of wavy convexes and concaves to absorb earthquake energy. This system requires computer controlled guidance to manage a piston assembly that will direct the rolling balls, it also has attenuator valve, power cylinders and pumps. This system is expensive, very complex and has many unique specialized parts, also this system not easy to create and will not scale up to handle very large structures, it also will require maintenance, to continue this system is more difficult to engineer. This system will need to be refurbished after quake events also this system can not handle large ground displacement or dissipate very much seismic energy. This system has no stated solution for a vertical displacement event and claims some energy damping. This pendulum like system seems to focus all the immense energy coming from a seismic event in to a few pivotal moving parts creating huge stresses making it very difficult to have long term reliability.

Another example is U.S. Pat. No. 6,862,849 B2 issued Mar. 8, 2005 to Kim. This system uses a bi-directional sliding pendulum like channels and articulated sliding channeled assemblies that attach to a structure. This system is expensive, complex and has many unique specialized parts, also this system not easy to create and will not scale up to handle very large structures, it also will require maintenance, to continue this system is more difficult to engineer. This system will need to be refurbished after quake events also this system can not handle large ground displacement or dissipate very much seismic energy. This system has no stated solution for a vertical displacement event and very limited energy damping. This pendulum like system seems to focus all the immense energy coming from a seismic event in to a few pivotal moving parts creating huge stresses making it very difficult to have long term reliability.

Yet another example is U.S. Pat. No. 6,164,022 issued Dec. 12, 2000 to Ishikawa et al. This system uses a three-dimensional guiding curved track rail apparatus on the bottom and on the top half, mounted at right angles. The connecting assembly has many parts including roller cylinders. This system is expensive, very complex and has many unique specialized parts, also this system not easy to create and will not scale up to handle very large structures, it also will require maintenance, to continue this system is more difficult to engineer. This system will need to be refurbished after quake events also this system can not handle large ground displacement or dissipate very much seismic energy. This system has no stated solution for a vertical displacement event and very limited energy damping. This pendulum like system seems to focus all the immense energy coming from a seismic event in to a few pivotal moving parts creating huge stresses making it very difficult to have long term reliability.

Another example is U.S. Pat. No. 6,820,380 B2 issued Nov. 23, 2004 to Chong-Shien Tsai In this system one contact surface between two slide block members with spheroid coupling bearing nested between upper and lower block members. This system is expensive, very complex and has many unique specialized parts, also this system not easy to create and will not scale up to handle very large structures, it also will require maintenance, to continue this system is more difficult to engineer. This system will need to be refurbished after quake events also this system can not handle large ground displacement or dissipate very much seismic energy. This system has no stated solution for a vertical displacement event and very limited energy damping. This pendulum like system seems to focus all the immense energy coming from a seismic event in to a few pivotal moving parts creating huge stresses making it very difficult to have long term reliability.

Another example is U.S. Pat. No. 6,385,917 issued May 14, 2002 to Masashi Konomoto The base isolation device with rail tracks disposed orthogonally to each other where a rotary sleeve and damping chamber filled with a viscous fluid. This system is expensive, very complex and has many unique specialized parts, also this system not easy to create and will not scale up to handle very large structures, it also will require maintenance, to continue this system is more difficult to engineer. This system will need to be refurbished after quake events also this system can not handle large ground displacement or dissipate very much seismic energy. This system has no stated solution for a vertical displacement event and has some limited energy damping. This pendulum like system seems to focus all the immense energy coming from a seismic event in to a few pivotal moving parts creating huge stresses making it very difficult to have long term reliability.

Another example is U.S. Pat. No. 7,409,799 B2 issued Aug. 12, 2008 to Tsai. This device has a top plate and base plate in between is the adapter with curved rails and rolling shafts placed at right angles. This system is expensive, complex and has many unique specialized parts, also this system not easy to create and will not scale up to handle very large structures, it also will require maintenance, to continue this system is more difficult to engineer. This system will need to be refurbished after quake events also this system can not handle large ground displacement or dissipate very much seismic energy. This system has no stated solution for a vertical displacement event and very limited energy damping. This pendulum like system seems to focus all the immense energy coming from a seismic event in to a few pivotal moving parts creating huge stresses making it very difficult to have long term reliability.

Another example is U.S. Pat. No. 7,472,518 B2 issued Jan.6, 2009 to Chong-Shien Tsai. This device has a sliding members mounted in two layers in between is two slotted seats with curved in opposites directions and rolling shafts placed at right angles and a dampening layer. This system is expensive, complex and has many unique specialized parts, also this system not easy to create and will not scale up to handle very large structures, it also will require maintenance, to continue this system is more difficult to engineer. This system will need to be refurbished after quake events also this system can not handle large ground displacement or dissipate very much seismic energy. This system has no stated solution for a vertical displacement event and very limited energy damping. This pendulum like system seems to focus all the immense energy coming from a seismic event in to a few pivotal moving parts creating huge stresses making it very difficult to have long term reliability.

Another example is U.S. Pat. No. 6,126,136 issued Oct. 3, 2000 to Yen et al. A passive vibration system with a protruding lug fitting in rubber snugly also two convex curved surface that will slide with wear-resistant resin layers. This system is expensive, complex and has many unique specialized parts, also this system not easy to create and will not scale up to handle very large structures, it also will require maintenance, to continue this system is more difficult to engineer. This system will need to be refurbished after quake events also this system can not handle large ground displacement or dissipate very much seismic energy. This system has no stated solution for a vertical displacement event and very limited energy damping. This pendulum like system seems to focus all the immense energy coming from a seismic event in to a few pivotal moving parts creating huge stresses making it very difficult to have long term reliability.

BRIEF SUMMARY OF THE INVENTION

The present invention advances the art of seismic wave base isolation devices for structures by its revolutionary design. It has a increased capacity to dissipate the kinetic energies of ground displacement. The present invention has a simple design and it is easy to understand also very strong and has a wider range of applications due to its increased operational parameters which goes well beyond the present prior art of base isolation systems. The preferred embodiment of this invention is the concept of the swing plate. The present invention introduces the swing plate element which is fundamentally a rectangular piece of rigid flat plate material with a rectangular slot cut out of the mid section allowing it to straddle a rectangular central wall support this arrangement is what creates the self balancing form of a pendulum system that carries the load and easily absorbs and dissipates horizontal displacement earthquake energy. Another preferred embodiment of this invention will leverage the swing plate concept to introduce the next advance that uses multiple swing plates placed in a row and straddling a rectangular central wall support thus creating the swing beam. This will be extended in the direction of its swinging movement such that the swing beam could be very long allowing it to stretch across the entire length of a foundation of a structure, if needed. The extending or lengthening of the swing beam creates a new building component. Another preferred embodiment of this invention will leverage the swing beam concept to introduce the next advance that uses multiple swing beams to create a swing beam foundation column. This is a structural arrangement of swing beam layers where more than one complete swing beam is set side by side such that a layer is produced then another layer is placed on top of that layer rotated, usually but not limited to 60 degrees from the next layer of swing beams below it to form a foundation column. This rotating of the next layer of swing beams in the stack is what will allow the swing beam foundation column to react to horizontal ground displacement in all directions. This system can easily be scaled to accommodate the largest of structures, or with smaller dimensions used to transport sensitive cargo such as explosives or electronic equipment while riding on trucks or trains. Here a cargo load can be carried by a swing beam arrangement also these arrangements need to be oriented toward the direction of travel. The present invention includes new design engineering that is simple very strong and has a far wider range of applications and operational parameters allowing the same design, which would be made of thicker and longer components can then be constructed to carry the largest of structure. A further object of the present invention is to provide seismic protection that is inexpensive to construct the present invention uses simple construction techniques and easily obtained materials usually but not limited to common plate steel. Another object of the present invention is to provide a protective system that is easy to assemble and requires little or no maintenance. How it operates is when the ground moves suddenly, as in a horizontal displacement, the swing plates will pivot around the fulcrum interface formed at the intersection of the plate and the plate rack which rests on top of the central wall support. In the first instant of time the structural load or building mass will try to remain at its original position as described by Newton's first law of motion. In a very short amount of time however the building mass will need to return to a point of equilibrium as a result of gravitational pull. The mass will move along the only path allowed by the swing plates which is a smooth pendulum arc. The return to a balanced point of gravitational equilibrium will not be as fast as the original ground movement that created the imbalance. A fast imbalance, followed by a slow return to balance is the essences of energy absorption or seismic wave motion dissipation and a variety of dampening strategies can be employed. It is doubtful that any other prior art in this field of invention can accommodate the amount of horizontal displacement as this present invention. The present invention incorporates a safe operational design by setting the range of pendulum motion to 30 degrees off center, this will become clearer when the drawing are viewed. Another object of the present invention is to make its application and subsequent deployment easy to understand, easy calculate and engineer. A simple and direct relationship exists when designing the appropriate swing plate and swing beam. You increase the height of swing plate to increase the allowable horizontal displacement that a structure can move without being damaged. The close approximation is 60 degrees of motion, 30 degrees off center in both directions, in a true pendulum arrangement is approximately the length of the radius or in this case the length of the leg of the swing plate. Using this present system to provide protection will mean that the structural engineer can easily redesign the size of the swing plate and swing beam to match the predicted ground movement. The minimum allowable horizontal displacement is usually cited by local area building codes. The present invention advances the art of seismic wave motion base isolation by the introduction of the swing plate and by its deployment inside the swing beam structure. Another object of the present invention is to provide a protective system that is capable of dealing with a vertical displacement of ground movement.

BRIEF DESCRIPTION OF THE DRAWINGS

For a full appreciation of the objects of this invention to be clearly understood and the advancement in the art of the field of this invention be made obvious we will fully describe them in the following drawings.

DETAILED DESCRIPTION OF THE INVENTION

Figure 1:
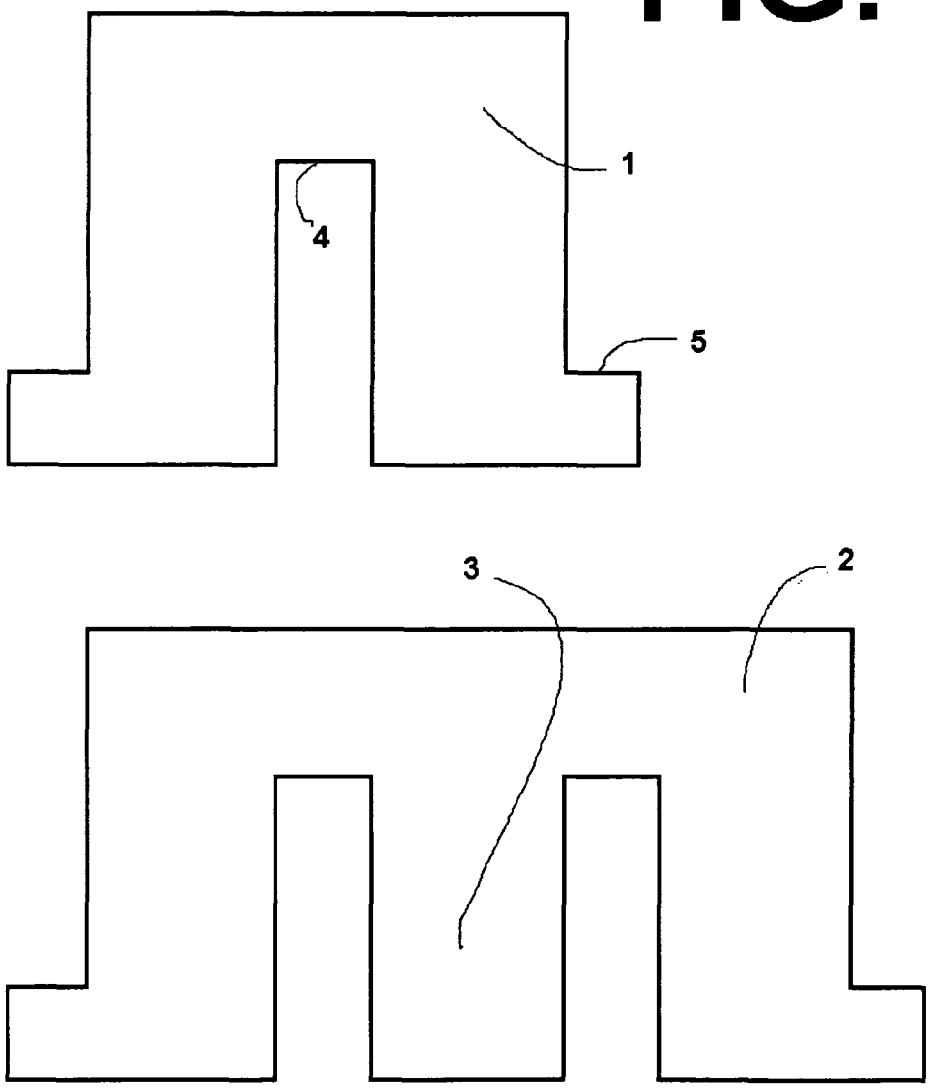
FIG. 1 shows the basic swing plate with single support wall slot as well as a double slot for two support walls.
Figure 2:
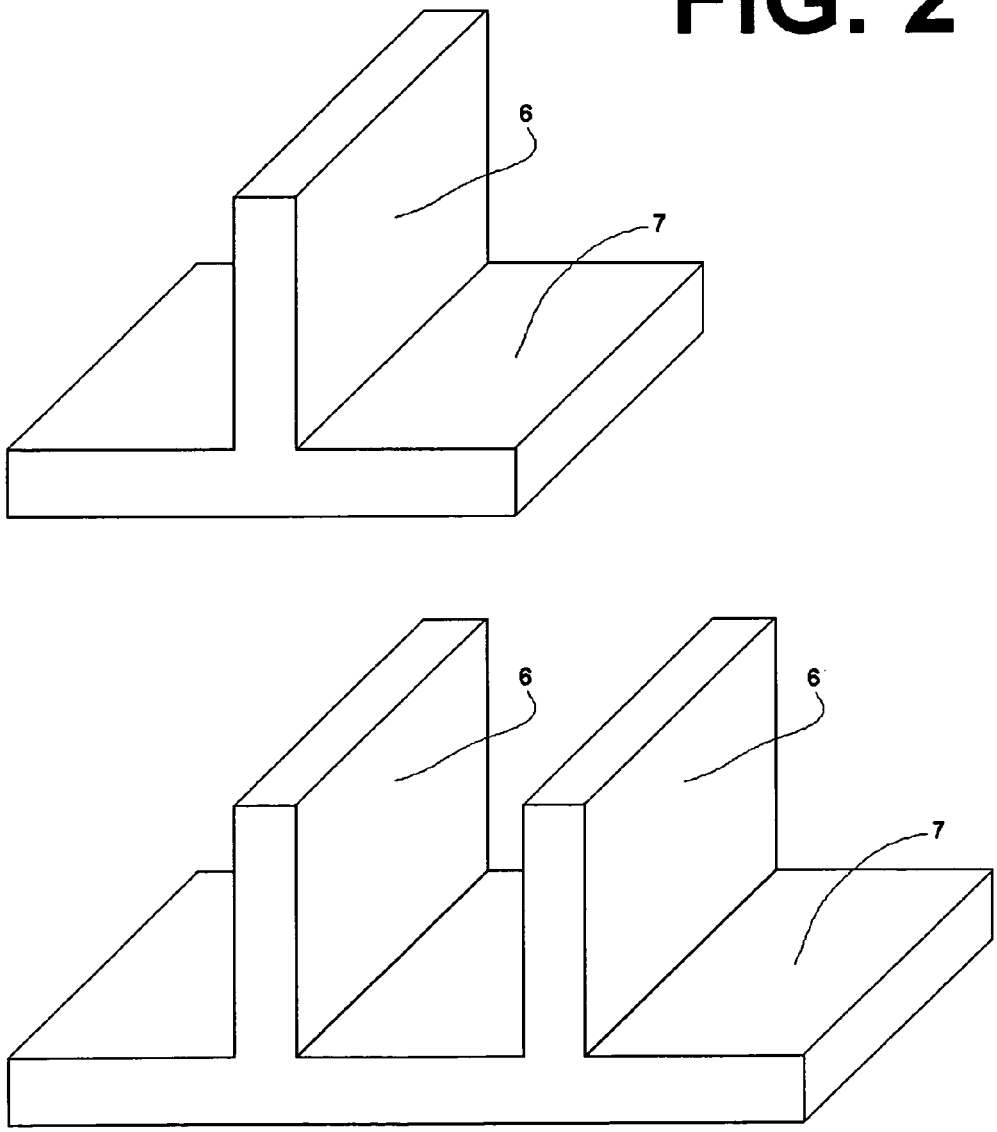
FIG. 2 shows the basic base and wall support for single and double.
Figure 3:
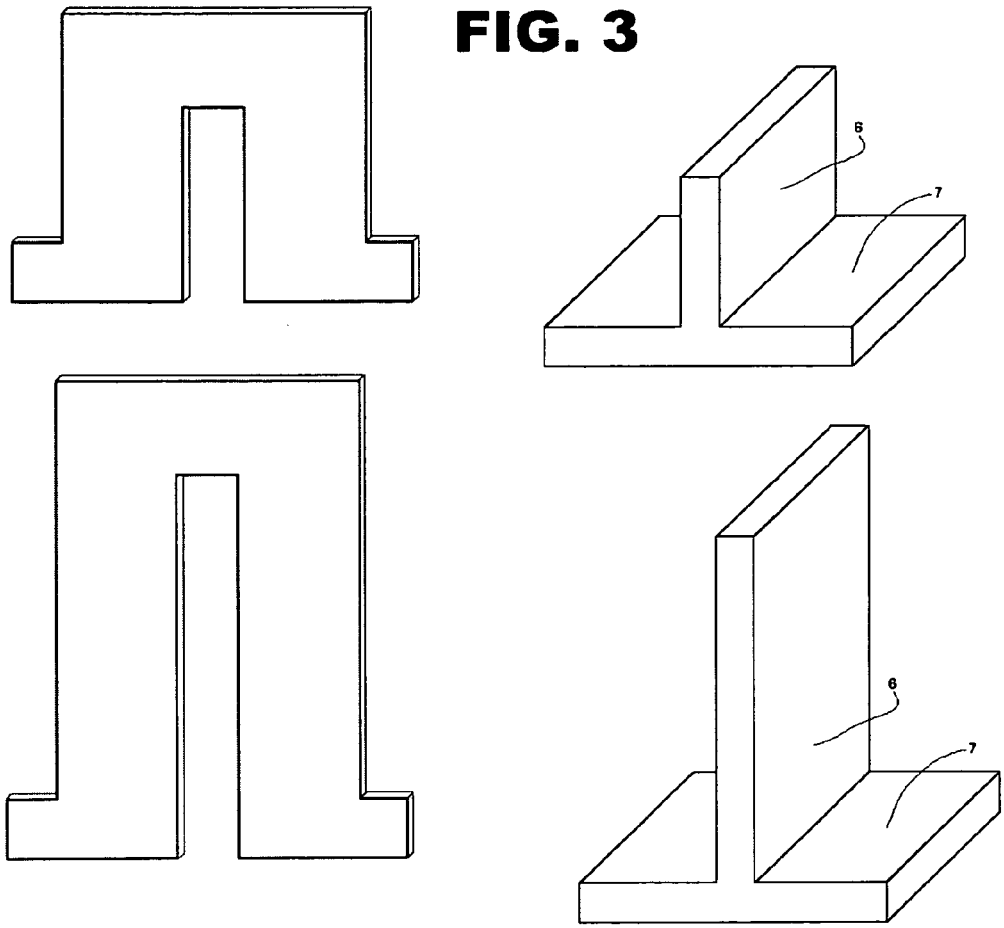
FIG. 3 shows the basic swing plate with single support wall slot as well as a longer version.
Figure 4:
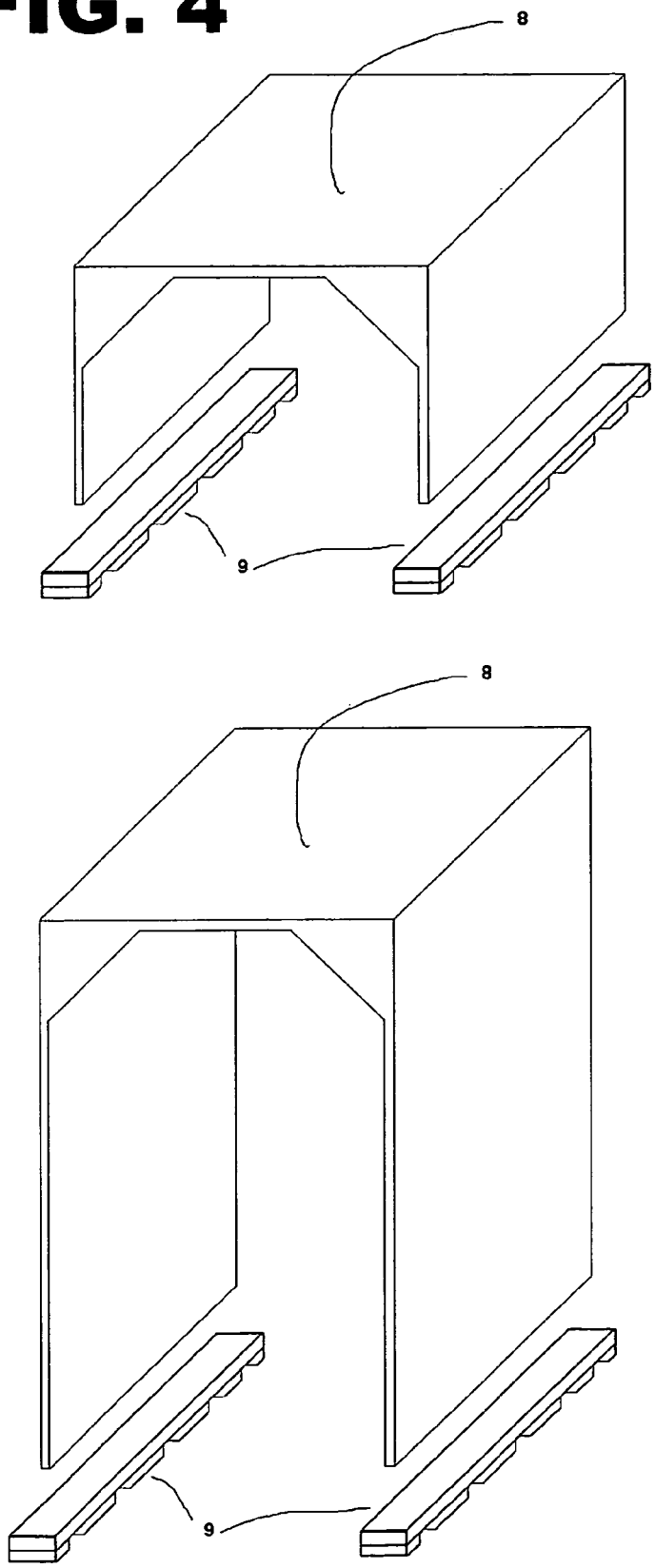
FIG. 4 shows the basic top table support structure with inverted plate racks on each side and a longer version.
Figure 5:
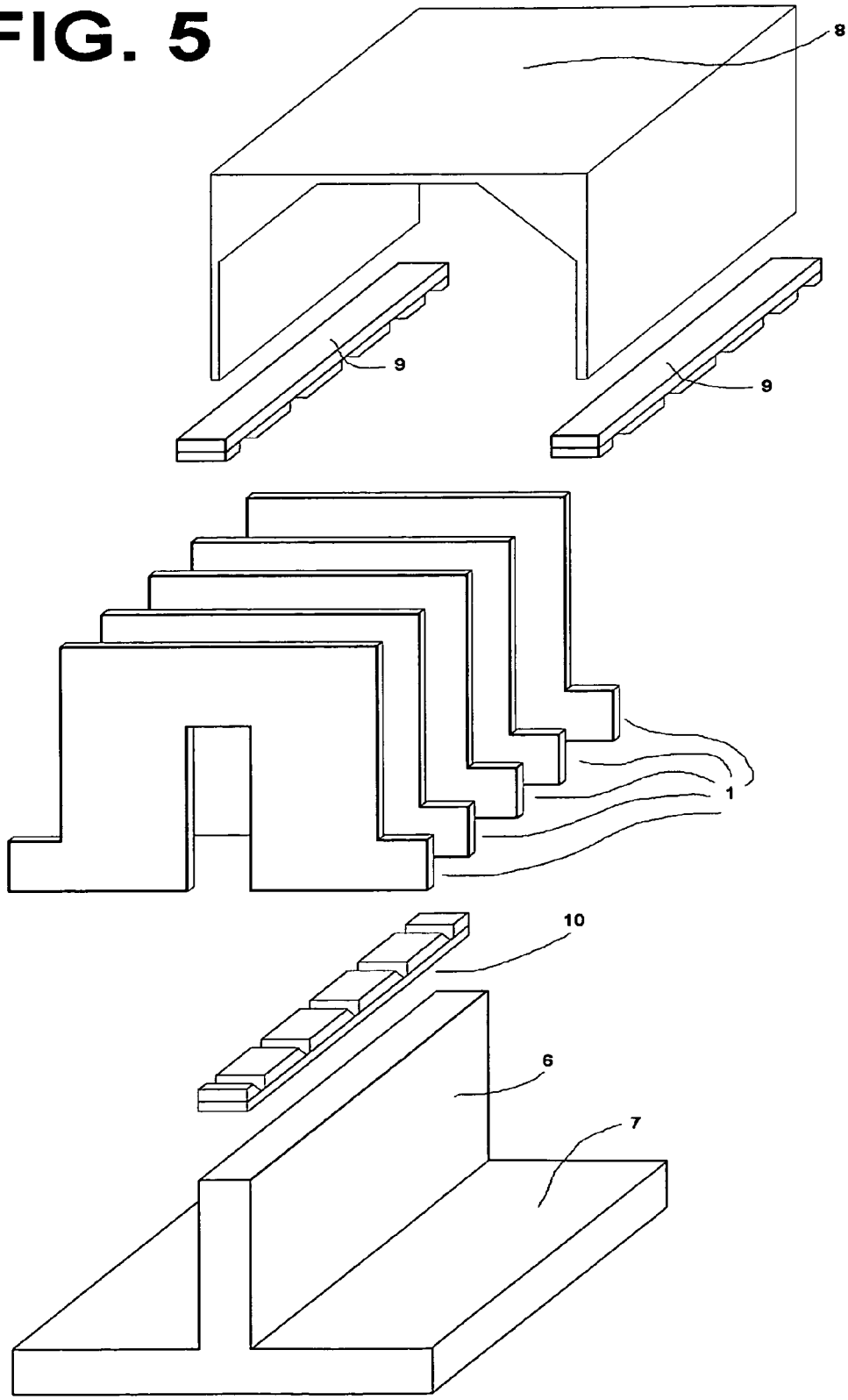
FIG. 5 shows an exploded view of the complete short version of a swing beam device comprising the base and wall with the plate rack on top.
Figure 6:
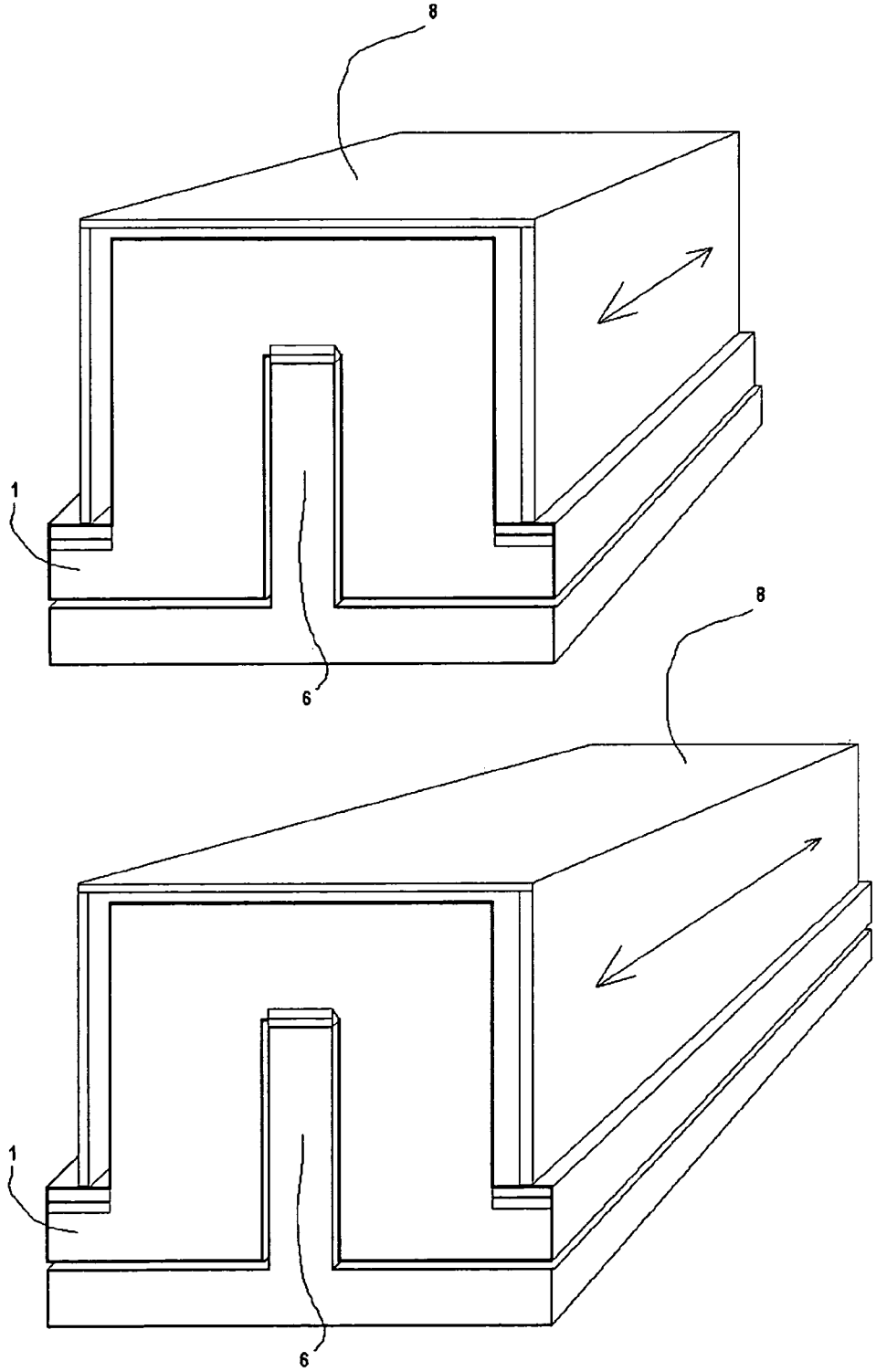
FIG. 6 shows the basic swing beam device fully assembled in short and longer view.
Figure 7:
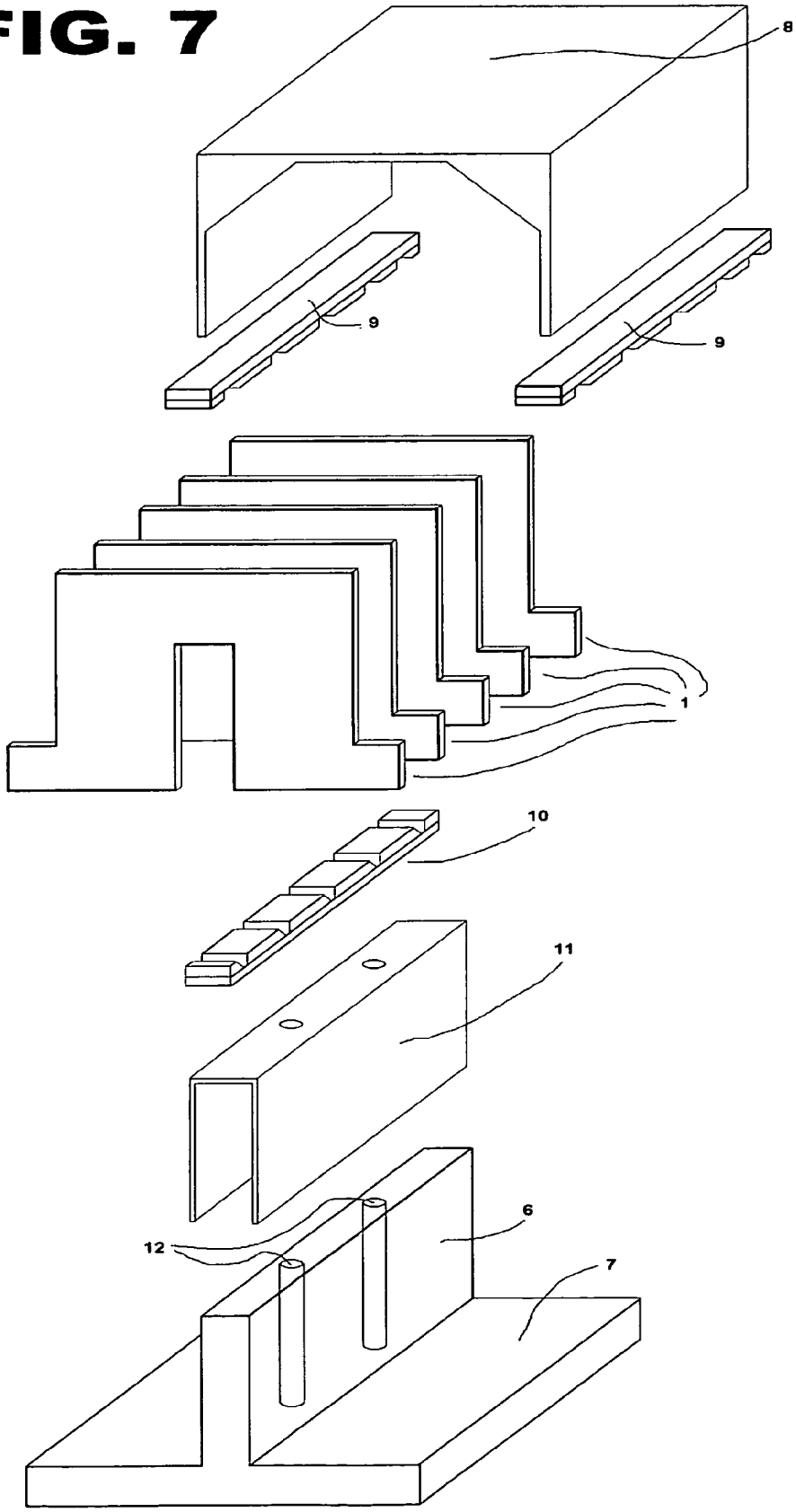
FIG. 7 shows an exploded view of the complete device comprising the base and wall with hydraulic ram shafts and the vertical wave slide structure with the plate rack on top.
Figure 8:
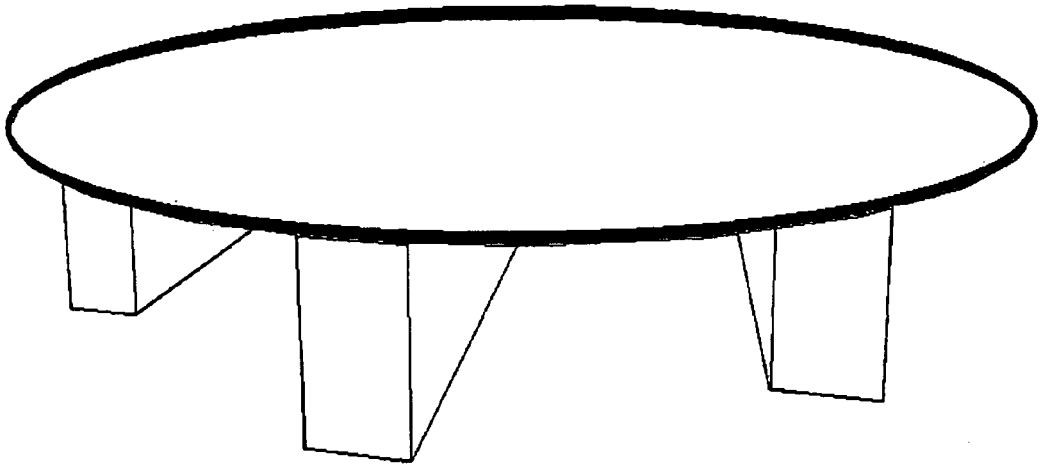
FIG. 8 shows a swing beam foundation island platform built of three swing beams with a large plate mounted on top.
Figure 9:
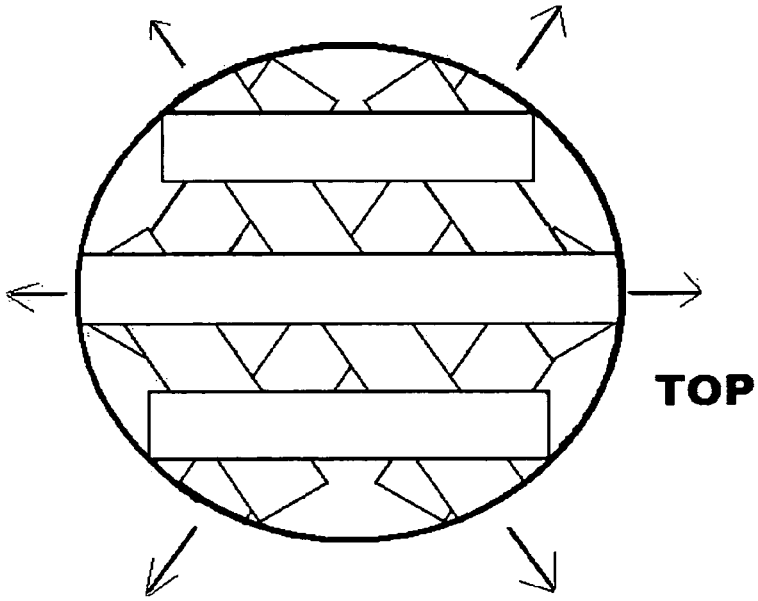
FIG. 9 shows a swing beam foundation island platform built of three swing beams with another three mounted on top at 60' degree angles, also a top cut away view.
Figure 9:
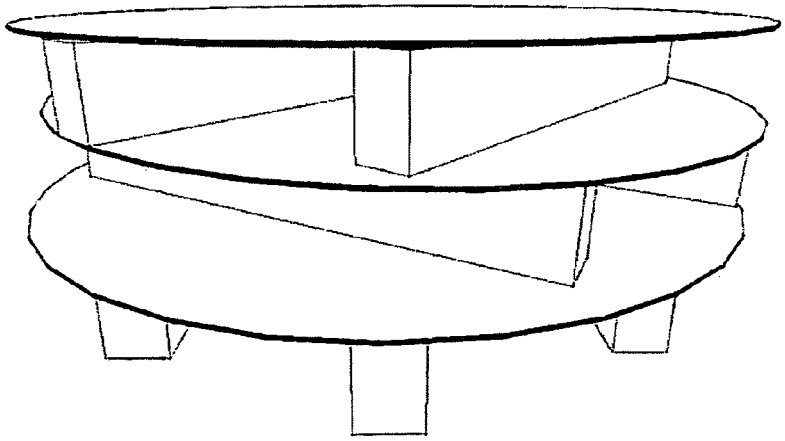
Figure 10:
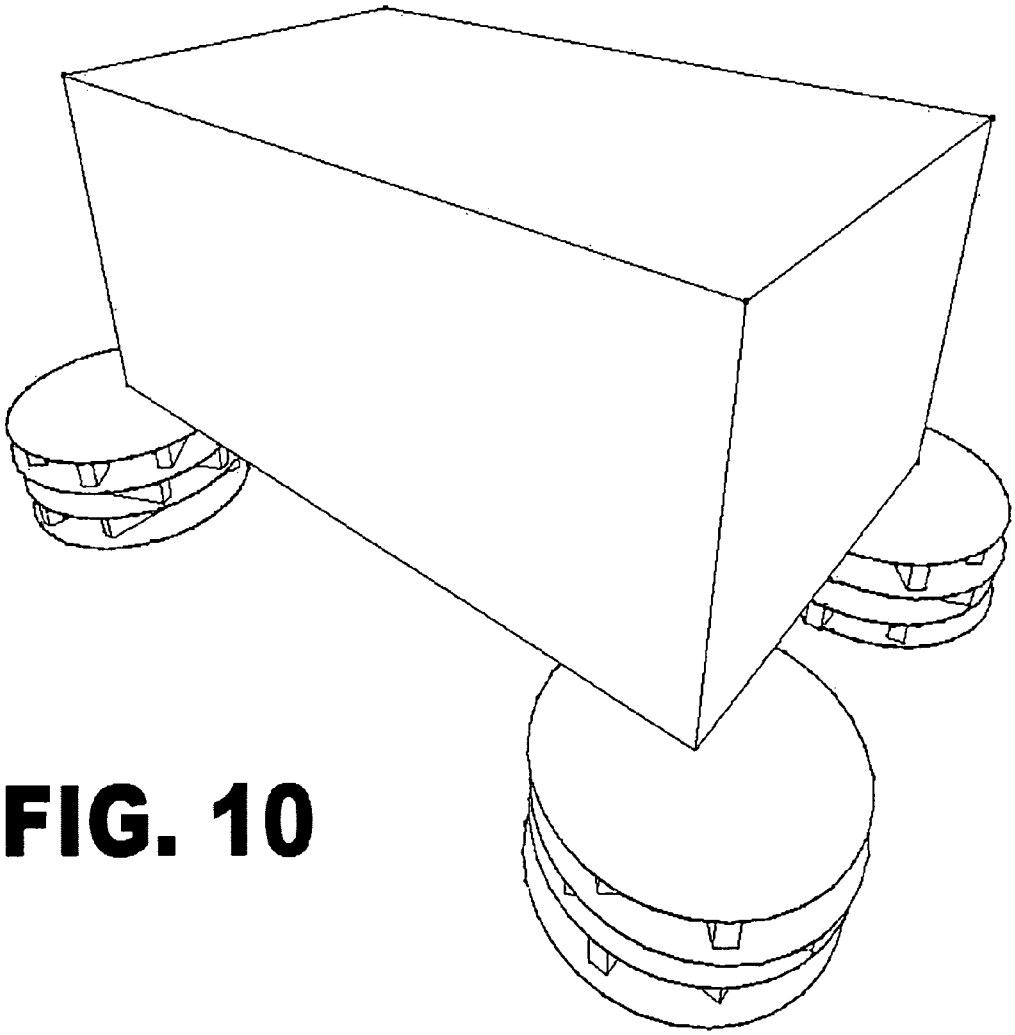
FIG. 10 shows a common multi story structure resting on swing beam foundation columns placed at it corners.

The preferred embodiment of this invention relates to a seismic wave motion isolation device for base or foundation structures and the transport of sensitive equipment. This device or apparatus will protect structures from the destructive effects of seismic wave motion in both the horizontal and vertical planes. The objects of invention are the swing plate and the swing beam. This seismic wave motion isolation device can be configured and built to protect the largest structures by scaling the dimensions and load capacities without altering the basic design. The dimensions are changed simply by altering length, width and height of the apparatus while the load capacities are mostly changed by increasing the size and thickness of the plate material used and the number of swing plates used. This seismic wave motion isolation device can be configured and built to protect the most sensitive of machinery, cargo or explosives transported via a truck or train. This seismic wave motion isolation device is uncomplicated in design and requires little maintenance. This seismic wave motion isolation device requires no electronics and monitoring. This seismic wave motion isolation apparatus is made from inexpensive and common materials. This seismic wave motion isolation device makes use of pendulum motion to gently redirect horizontal ground displacements set in motion by earthquake events. When the ground moves suddenly, as in a horizontal displacement, the swing plates will pivot around the fulcrum interface formed at the intersection of the plate and the plate rack which rests on top of the central wall support. In the first instant of time, the structural load or building mass will try to remain at its original position as described by Newton's first law of motion. In a very short amount of time after the event, the building mass will need to return to a point of equilibrium as a result of gravitational forces. The mass will move along the path allowed by the swing plates which is a smooth pendulum arc. The return to a balanced point of gravitational equilibrium will not be as fast as the original ground movement that created the imbalance. A fast imbalance followed by a slow return to balance, is the essences of energy absorption or seismic wave motion dissipation. The following drawings are presented to more fully explain this invention and the new engineering designs which represent an advance in the art and are considered part of the specifications. As is illustrated in FIG. 1, this clearly shows the basic swing plate design 1 a preferred embodiment of this invention, 4 shows the flat upper edge of the slot known as the fulcrum interface that the plate will pivot on, 5 shows the flat edge that will form another fulcrum interface when a plate rack is placed their in a upside-down orientation, this will support the top table structure also presented is the more advanced swing plate 2 that used two slots forming a central panel 3 which will be used for swing dampening. The number of slots can be extended as the need for increased strength and dampening is required. The swing plate is made of a ridged material usually but not limited to steel or metal, its general shape is rectangular with a smaller rectangular slot cut in the center to receive a wall support, the general shape is like a squared off capital letter U or W turn upside down, for smaller systems the use of strong plastics will be adequate also plastics can be utilized where sparks could be hazardous and need to be suppressed like in a explosion proof environment. For very large swing beam systems steel reinforced concrete can be used. FIG. 2 clearly shows, in a elevated orthogonal view, a standard base support 7 and wall support 6, this is a single structure which looks like a large upside down capital letter T, also shown is a double walled base pad. The base has to match the swing plates it will carry. This structure is made of a ridged material usually but not limited to steel or metal, for smaller systems the use of strong plastics will be adequate also plastics can be utilized in an explosion proof environment. The rectangular volume between the support walls can be used for swing motion dampening, another preferred embodiment of this invention. There are many strategies for dampening the motion by impeding the movement of this central panel such as but not limited to a viscous liquid. Other dampening strategies are mechanized using springs, gears or weighted pulley systems. FIG. 3 clearly shows a standard base support and matching swing plates. FIG. 4 clearly shows in an elevated orthogonal view, a standard top table structure 8 which has the strength to carry the load that matches the strength of the base support and swing plates. Also displayed are the, two upside down plate racks 9 attached to the top table this is designed to hold and align the motion of the swing plates, with the channels cut in to the plate racks. This structure is made of a ridged material usually but not limited to steel or metal, for smaller systems the use of strong plastics will be adequate also plastics can be utilized in an explosion proof environment. FIG. 5 clearly shows in an elevated orthogonal view, a swing beam in an unassembled exploded view, a preferred embodiment of this invention. The swing beam is comprised of the top table 8, the plate racks 9, the swing plates 1, the wall plate rack 10, the base support 7 and the wall 6. This structure is made of a ridged material usually but not limited to steel or metal, for smaller systems the use of strong plastics will be adequate also plastics can be utilized where sparks are dangerous and need to be suppressed such as in an explosion proof environment. FIG. 6 clearly shows in an elevated orthogonal view, a short swing beam and a long swing beam device completely assembled 1, 6, 8, it resembles a rectangular box. FIG. 7 clearly shows in an elevated orthogonal view, a swing beam in an unassembled exploded view, another preferred embodiment of this invention. The swing beam is comprised of the top table 8, the plate racks 9, the swing plates 1, the wall plate rack 10, the vertical wave sleeve 11, the ram silo's 12, the base support 7 and the wall 6, the rams are similar to what is found in a standard hydraulic lifting jack, here the top of the ram is affixed to the vertical wave sleeve 11. This arrangement will allow the rams to extend easily during a quick vertical displacement but return slowly by comparison. This fluid exchange and action is accomplished by the use of one way hydraulic values. This hydraulic process is responsible for the absorption and dissipation of vertical displacement energy. This structure is made of a ridged material usually but not limited to steel or metal, for smaller systems the use of strong plastics will be adequate also plastics can be utilized where sparks are dangerous and need to be suppressed such as in an explosion proof environment. FIG. 8 clearly shows a cut away frontal view of a single layer of a swing beam foundation column, with three beams are in parallel attached to a round steel plate. FIG. 9 clearly shows in an elevated orthogonal side view, a complete three layered swing beam foundation column where each layer is set at 60 degree angles to each other, this will allow a building to sway in all directions of ground displacement also illustrated is a cut away top view looking down on a layered swing beam foundation column where each layer is set at 60 degree angles to each other. A swing beam foundation column is built when we stack the swing cell layers on top of other swing cell layers. Each swing cell layer in the stack can be rotated to allow for displacement absorption in all directions as illustrated. FIG. 10 clearly shows in an elevated orthogonal view, a common multi story structure placed on a set of swing beam foundation columns placed on each corner.

In view of the above, it has been shown that the many advantages of the present invention of a seismic wave motion isolation device for base or foundation structures have been achieved. As various changes could be made in the above examples of construction without departing from the scope of the invention, it is intended that all of the above descriptions of the preferred embodiments of this invention or shown in the accompanying drawings shall be interpreted as illustrative and not in a limiting sense. Accordingly, the drawings and description presented for this invention are intended to embrace all alternatives, modifications, and variations that fall within the spirit and scope of the of preferred embodiments.

What is claimed:

1. A seismic base isolation and energy dissipation apparatus comprising:

a swing beam comprising;

an inverted T-shaped base plate having a web and a substantially perpendicular flange, the flange having a top surface;

an elongate beam disposed on the top surface of the flange, the elongate beam having notches on a top surface;

a plate rack, wherein the plate rack comprises;

two elongate beams having a plurality of notches on each respective bottom surface;

a housing disposed on top of the two elongate beams;

a plurality of substantially flat plates;

a slot in each of the plurality of plates extending from a bottom surface; and wherein the innermost portion of each respective slot rests on a respective notch of the elongate beam disposed on the housing.

2. The seismic base isolation and energy dissipation apparatus of claim 1 further comprising:

a first set of three parallel swing beams and a first sheet of metal disposed on top of the first set of three swing beams;

a second set of three parallel swing beams disposed on top of the first sheet of metal and a second sheet of metal disposed on top of the second set of three parallel swing beams;

wherein the second set of three parallel swing beams is offset 60 degrees from the first set of three parallel swing beams; and a third set of three parallel swing beams disposed on top of the second sheet of metal and a third sheet of metal disposed on top of the third set of three parallel swing beams;

wherein the third set of three parallel swing beams is offset 60 degrees from the second set of three parallel swing beams.

3. The seismic base isolation and energy dissipation apparatus of claim 2 further comprising:

vertical apertures disposed in the top surface of the flange of the base plate; and a vertical-wave absorption unit comprising a row of hydraulic rams disposed within the apertures of the flange of the base plate, the hydraulic rams configured to absorb vertically oriented shocks through fluid displacement.

* * * * *